US011421690B2

(12) United States Patent
Liu et al.

(10) Patent No.: US 11,421,690 B2
(45) Date of Patent: Aug. 23, 2022

(54) SILENCER AND COMPRESSOR

(71) Applicants: GREE ELECTRIC APPLIANCES (WUHAN) CO., LTD, Hubei (CN); GREE ELECTRIC APPLIANCES, INC. OF ZHUHAI, Guangdong (CN)

(72) Inventors: Hua Liu, Guangdong (CN); Cong Cao, Guangdong (CN); Tianyi Zhang, Guangdong (CN); Yushi Bi, Guangdong (CN); Qiangjun Meng, Guangdong (CN); Ziyuan Huang, Guangdong (CN); Helong Zhang, Guangdong (CN)

(73) Assignees: GREE ELECTRIC APPLIANCES (WUHAN) CO., LTD, Hubei (CN); GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 44 days.

(21) Appl. No.: 16/633,576

(22) PCT Filed: Dec. 18, 2017

(86) PCT No.: PCT/CN2017/119318
§ 371 (c)(1),
(2) Date: Jan. 23, 2020

(87) PCT Pub. No.: WO2019/033679
PCT Pub. Date: Feb. 21, 2019

(65) Prior Publication Data

US 2020/0166035 A1 May 28, 2020

(30) Foreign Application Priority Data

Aug. 18, 2017 (CN) ..... 201710711711.3

(51) Int. Cl.
*F04C 29/06* (2006.01)
*F04C 18/16* (2006.01)

(52) U.S. Cl.
CPC ..... *F04C 29/06* (2013.01); *F04C 18/16* (2013.01); *F04C 29/065* (2013.01); *F04C 29/068* (2013.01)

(58) Field of Classification Search
CPC ..... F04C 29/06; F04C 29/068; F04C 29/065; F04C 18/16; F04C 29/061; B01D 46/521;
(Continued)

(56) References Cited

U.S. PATENT DOCUMENTS 806,714 A 12/1905 Porter
2,009,343 A * 7/1935 Peik ..... F01N 1/06 181/256
(Continued)

FOREIGN PATENT DOCUMENTS

CN 2104303 U 5/1992
CN 1944971 A 4/2007
(Continued)

OTHER PUBLICATIONS

English Machine Translation of JP 10-141041A, translated by Espaceneton May 21, 2021 (Year: 1998).*
(Continued)

*Primary Examiner* — Dominick L Plakkoottam
*Assistant Examiner* — Paul W Thiede
(74) *Attorney, Agent, or Firm* — Brandon V. Zuniga; James R. Gourley; Carstens & Cahoon, LLP

(57) ABSTRACT

Disclosed are a silencer and a compressor with same. The silencer includes a housing, a gas inlet end of the housing being provided with a protrusion extending into an interior of the housing, a portion of the protrusion approximate to a gas outlet end of the housing being closed, and the gas inlet end of the housing being provided with at least two gas inlets around the protrusion. A part of a gas flow enters the housing through the gas inlets, and other part of the gas flow impacts
(Continued)

the protrusion and then at least partially flows back and enters the housing through the gas inlets.

10 Claims, 2 Drawing Sheets

(58) Field of Classification Search
CPC ..... F04D 29/66; F04D 29/663; F04D 29/664; F04D 29/668
See application file for complete search history.

(56) References Cited

U.S. PATENT DOCUMENTS

| | | | | | |
|---|---|---|---|---|---|
| 3,086,611 | A * | 4/1963 | Nelson | F01N 1/084 | 181/265 |
| 4,125,171 | A * | 11/1978 | Morris | F01N 13/1805 | 181/265 |
| 4,164,266 | A * | 8/1979 | Collin | F01N 1/003 | 181/250 |
| 4,770,615 | A * | 9/1988 | Fujiwara | F04C 18/16 | 418/15 |
| 5,839,405 | A * | 11/1998 | Falkowski | F02M 35/1216 | 123/184.57 |
| 6,467,572 | B1 * | 10/2002 | Liu | F01N 1/006 | 181/272 |
| 8,142,172 | B2 * | 3/2012 | Forster | F04C 29/061 | 417/312 |
| 8,197,188 | B2 * | 6/2012 | Clay | F04D 29/4213 | 415/119 |
| 8,408,357 | B2 * | 4/2013 | Cheung | F02M 35/1216 | 181/224 |
| 10,024,228 | B2 * | 7/2018 | Gong | F02B 37/16 | |
| 2004/0261621 | A1 * | 12/2004 | Lindsay | B01D 46/521 | 96/388 |
| 2006/0239836 | A1 | 10/2006 | Forster | | |
| 2008/0056882 | A1 * | 3/2008 | Clay | F04D 29/685 | 415/55.6 |
| 2008/0166253 | A1 * | 7/2008 | Fujimoto | F04C 28/06 | 418/201.1 |
| 2016/0003246 | A1 * | 1/2016 | Mizufune | F04C 28/28 | 418/55.1 |
| 2016/0084521 | A1 * | 3/2016 | Jung | B60H 1/00571 | 62/296 |
| 2017/0101924 | A1 * | 4/2017 | Gong | F02B 37/12 | |

FOREIGN PATENT DOCUMENTS

| | | | | |
|---|---|---|---|---|
| CN | 103954085 | A | 7/2014 | |
| CN | 205078322 | U | 3/2016 | |
| CN | 106321193 | A | 1/2017 | |
| CN | 107288878 | A | 10/2017 | |
| CN | 206600192 | U | 10/2017 | |
| CN | 207080359 | U | 3/2018 | |
| EP | 2378125 | A2 * | 10/2011 | F04C 29/12 |
| JP | H09310610 | A | 12/1997 | |
| JP | 10141041 | A * | 5/1998 | F01N 1/166 |
| WO | WO-0111206 | A2 * | 2/2001 | A47L 5/22 |

OTHER PUBLICATIONS

English Machine Translation of CN1944971A on Dec. 5, 2021 via Espacenet (Year: 2007).*
Extended European Search Report for Application No. 17921746.8 dated Jun. 8, 2020 (6 pages).
International Search Report dated May 9, 2018 for PCT/CN2017/119318 (4 pages).
Office Action for Chinese Application No. 201710711711.3 dated Aug. 15, 2019 (6 pages).
Office Action for Indian Application No. 202037005930 dated Nov. 25, 2020 (5 pages).

* cited by examiner

SILENCER AND COMPRESSOR

This application is a U.S. National Stage of International Application No. PCT/CN2017/119318, filed on Dec. 18, 2017, and published as WO 2019/033679 on Feb. 21, 2019, which claims priority to Chinese invention patent application No. 201710711711.3, titled "Silencer and Compressor", filed on Aug. 18, 2017. The contents of each application, publication and patent listed in this paragraph are hereby incorporated by reference in their entireties.

TECHNICAL FIELD

The present disclosure relates to a silencer and a compressor.

BACKGROUND

When the screw compressor is operating, continuous noise will be generated in the compressor due to the pulsation of the discharge pressure. The methods of reducing the pulsations of the discharge pressure are generally to provide a silencer on the discharge pipe to reduce the noise spread along the pipe. The method of providing a silencer on the discharge pipe is only applicable for the screw compressor which has an oil separation barrel structure and has enough space allowing the arrangement of the discharge pipe. For the compressor without a built-in discharge pipe, such as a low-temperature compressor or an open-type compressor, especially the type of a one-unit two-stage screw compressor with two stages of discharge, it is impossible to arrange a conventional silencer due to structural limitations of the compressor. Moreover, limited by the space of the discharge flow channel, a conventional silencer cannot be arranged therein either.

SUMMARY

The present disclosure provides a silencer occupying small space and facilitating installation, and provides a compressor.

This present disclosure provides a silencer including a housing; wherein a protrusion is arranged in a gas inlet end of the housing and extends into an interior of the housing; a portion of the protrusion, which is proximate to a gas outlet end of the housing, is closed; at least two gas inlets are arranged in the gas inlet end of the housing and disposed around the protrusion; enabling that a part of a gas flow flows through the gas inlets and enters the housing; another part of the gas flow impacts the closed portion of the protrusion, and at least partially flows back and enters the housing through the gas inlets.

Optionally, the protrusion is a solid structure.

Optionally, the protrusion is a hollow structure; the protrusion comprises a top wall; the top wall is a closed portion; the gas flow impacts the top wall and flows back when it enters the protrusion.

Optionally, the protrusion comprises a circumferential side wall, and the circumferential side wall is provided with a through opening that is in communication with the interior of the housing.

Optionally, a size of the through opening is smaller than a size of the gas inlet.

Optionally, a filter screen is arranged inside the housing; in a direction of the gas flow in the housing, the filter screen is arranged downstream of the protrusion.

Optionally, a distance between the filter screen and the protrusion is 10 mm or more.

Optionally, apertures are provided on an inner wall of the housing.

Optionally, a check valve is arranged on the gas outlet end of the housing.

Optionally, the silencer includes a cut-off valve, and in a direction of the gas flow, the cut-off valve is provided downstream of the check valve.

The present disclosure provides a compressor, including the silencer of any one of the embodiments.

Optionally, the compressor includes a screw compressor.

Optionally, the silencer is disposed at a discharge port of the screw compressor.

Based on the above technical solutions, the present disclosure has at least the following beneficial effects:

In the silencer provided by the embodiments of the present disclosure, at least two gas inlets are arranged in the gas inlet end of the housing and disposed around the protrusion, so that the gas flow entering the housing through the gas inlet end of the housing can be divided. The protrusion extends to the interior of the housing, and the portion of the protrusion, which is proximate to the gas outlet end of housing, is closed, therefore, after impacting the closed portion of the protrusion, the gas flow can flow back. Multiple streams of the gas flow that enter the housing and surround the protrusion impact and gather together, and then are discharged out of the gas outlet end of the housing, which can effectively reduce the velocity of the gas flow, attenuate the acoustics wave energy and reduce noise. Moreover, the silencer provided by the embodiments of the present disclosure has a simple structure, facilitates installation, and occupies smaller space.

Exemplary embodiments of the present disclosure will be described hereafter with reference to the accompanying drawings, and other features and advantages of the present disclosure will become clear.

BRIEF DESCRIPTION OF DRAWINGS

The accompanying drawings attached to the description form a part of the disclosure and are intended to provide a further understanding of the present disclosure. The illustrative embodiments of the present disclosure and the description thereof are used for explanations of the present disclosure, but are not intended to inappropriately limit the present disclosure. In the accompanying drawings.

REFERENCE SIGNS IN THE FIGURES

Figure 1:
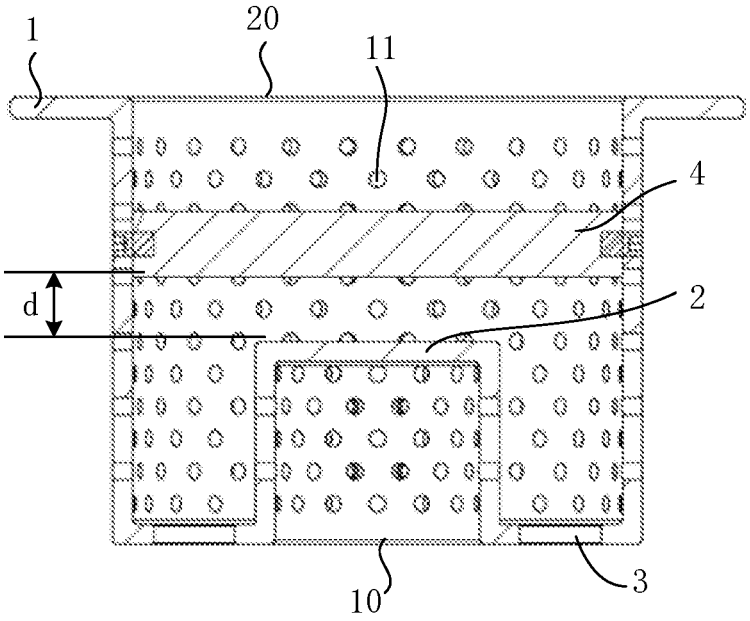
FIG. 1 is a schematic structural diagram of a silencer according to one or more embodiments of the present disclosure.

1—housing; 11—aperture;
2—protrusion; 21—top wall; 22—circumferential side wall; 23—through opening;
3—gas inlet;
4—filter screen;
5—check valve;

6—cut-off valve;
7—body;
8—rotor assembly,
10—gas inlet end;
20—gas outlet end;
d—distance between filter screen (4) and protrusion (2).

DETAILED DESCRIPTION OF DISCLOSED EMBODIMENTS

The technical solutions in the embodiments of the present disclosure will be clearly and completely described hereafter with reference to the accompanying drawings in the embodiments of the present disclosure. Apparently, the embodiments described are merely some embodiments, but not all embodiments of the present disclosure. The following description of at least one exemplary embodiment is merely illustrative, but not intended to limit the present disclosure and the application or the use thereof. Based on the embodiments of the present disclosure, other embodiments obtained by a person of ordinary skill in the art without creative efforts all fall within the protection scope of the present disclosure.

Unless otherwise specified, the relative arrangements of the components and steps, numeric expressions and values described in these embodiments are not intended to limit the scope of the disclosure. Moreover, it should be understood that, for convenience of description, the dimensions of the parts shown in the accompanying drawings are not drawn to scale according to the actual proportion. The technologies, methods and equipment known to those of ordinary skill in the art may not be discussed in detail, but, where appropriate, the technologies, the methods and the equipment shall be considered as part of the granted specification. In all the examples shown and discussed herein, any specific value should be interpreted as merely an example, but not as a limitation. Other examples of illustrative embodiments may therefore have different values. It should be noted that similar reference numerals and letters in the following figures denote similar terms, therefore once a particular term is defined in one of the figures, no further discussion is required in the subsequent figures.

In the description of the present disclosure, it should be understood that orientations or position relationships, indicated by the terms such as "center", "longitudinal", "transverse", "front", "back", "left", "right", "vertical", "horizontal", "top", "bottom", "inside", "outside" and so on, are based on the orientations or position relationships shown in the drawings, and are merely used for conveniently describing the present disclosure and simplifying the description, rather than indicating or implying that the apparatus or element referred to definitely has a particular orientation, or is constructed and operated in a particular orientation, and thus are not to be understood to limit the protection scope of the present disclosure.

FIG. 1 illustrates a silencer of one or more exemplary embodiments provided by the present disclosure. The silencer includes a housing 1. A gas inlet end 10 of housing 1 is provided with a protrusion 2 extending into an interior of the housing 1, and a portion of the protrusion 2, which is proximate to a gas outlet end 20 of the housing 1, is closed. At least two gas inlets 3 are arranged in the gas inlet end 10 of the housing 1 and disposed around the protrusion 2. A part of the gas flow flows through the gas inlets 3 and enters the housing 1; another part of the gas flow impacts the closed portion of the protrusion 2, which is proximate to the gas outlet end 20 of the housing 1, and then at least partially flows back and enters the housing 1 through the gas inlets 3.

Figure 3:
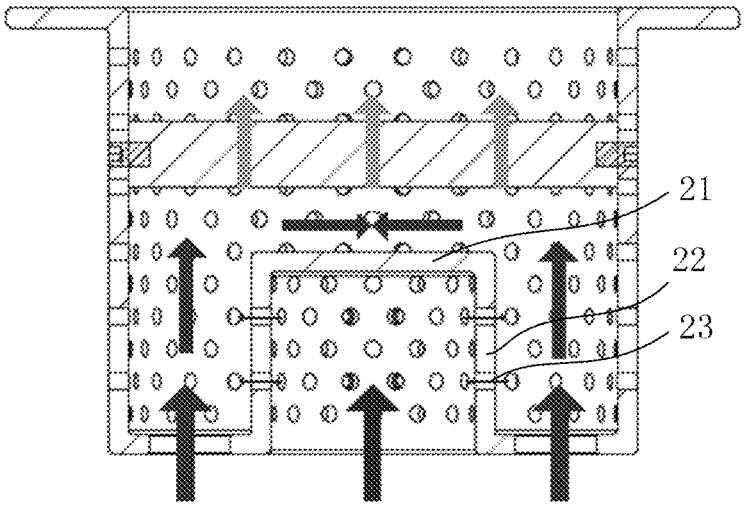
FIG. 3 is a schematic diagram illustrating directions of a gas flow inside the silencer according to one or more embodiments of the present disclosure.

As shown in FIG. 3, in some embodiments, since at least two gas inlets 3 are arranged in the gas inlet end 10 of the housing 1 and disposed around the protrusion 2, the gas flow entering the housing 1 through the gas inlet end 10 of the housing 1 can be divided. The protrusion 2 extends to the interior of the housing 1, and the portion of the protrusion 2, which is proximate to the gas outlet end 20 of housing 1, is closed, therefore, after impacting the closed portion of the protrusion 2, the gas flow can flow back. Multiple streams of the gas flow that enter the housing 1 and surround the protrusion 2 impact and gather together, and then are discharged out of the gas outlet end 20 of the housing 1, which can effectively reduce the velocity of the gas flow, attenuate the acoustics wave energy and reduce noise.

The silencer provided by the embodiments of the present disclosure has a simple structure, facilitates installation, and occupies smaller space. The size of the silencer can be adjusted according to the actual space, and the structure is unchanged. What's more, after the gas flow flows through the silencer, the acoustic wave energy can be attenuated and absorbed, thereby reducing discharge noise and guaranteeing effects of noise elimination.

In some embodiments, as shown in FIG. 1, the protrusion 2 arranged at the gas inlet end 10 of the housing 1 can be a solid structure or a hollow structure.

In the embodiments that the protrusion 2 is a solid structure, after impacting the protrusion 2, the gas flow all flows back, and then flows through the gas inlets 3 and enters the housing 1.

In the embodiments that the protrusion 2 is a hollow structure, as shown in FIG. 3, the protrusion 2 can include a top wall 21 and a circumferential side wall 22. The top wall 21 is a closed portion; the gas flow enters the protrusion 2 and impacts the top wall 21, then flows back and enters the housing 1 through the gas inlets 3.

In the embodiments that the protrusion 2 is a hollow structure, after impacting the protrusion 2, the gas flow can all flow back; alternatively the circumferential side wall 22 of the protrusion 2 is provided with a through opening 23 that is in communication with the interior of the housing 1, which enables at least a part of the gas flow to flow back after impacting the protrusion 2, and another part of the gas flow to enter the housing 1 through the through opening 23, impacting and gathering together with the gas flow entering the housing 1 through the gas inlets 3, thereby further reducing the velocity of the gas flow and attenuating the acoustics wave energy.

In some embodiments, the size of the through opening 23 disposed in the circumferential side wall 22 of the protrusion 2 is smaller than the size of the gas inlet 3, so that most of the gas flows back after impacting the protrusion 2, and a small part of the gas flow enters the housing 1 through the through opening 23.

Figure 2:
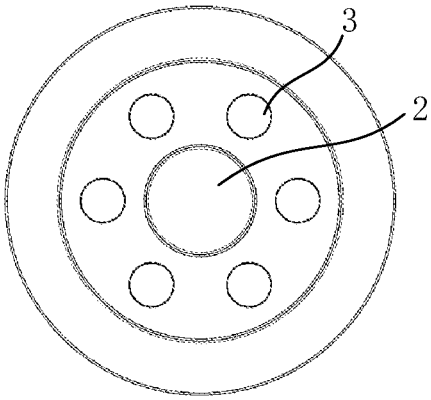
FIG. 2 is a schematic top view of the silencer according to one or more embodiments of the present disclosure.

As shown in FIG. 2, taking requirements of the discharge volume into consideration, in the silencer provided by the embodiments of the present disclosure, an array of six inlets are arranged uniformly in the gas inlet end 10 of the housing 1 of the silencer and disposed around the protrusion 2. However, in practice, according to the requirements of the discharge volume, two, three, four, five, six or more inlets can be provided, as long as multiple streams of the gas flow can be ensured to impact each other.

As shown in FIG. 1, in the silencer provided in some embodiments, a filter screen 4 can be arranged inside the housing 1. In the direction of the gas flow in the housing 1, the filter screen 4 is arranged downstream of the protrusion 2. On one hand, the filter screen 4 can enhance the absorption of the acoustics wave energy, and on the other hand, the filter screen can also take effects in separating oil and gas, so as to improve the energy efficiency of the compressor.

In order to ensure that the multiple streams of the gas flow entering the housing 1 through the gas inlets 3 can fully impact and mix in the space between the filter screen 4 and the closed portion of the protrusion 2, the distance d between the filter screen 4 and the protrusion 2 can be 10 mm or more.

In some embodiments, the filter screen 4 may be a metal filter screen. The filter screen 4 can be fixed to the housing 1 with a set screw.

As shown in FIG. 1, in some embodiments, apertures 11 or a plate with apertures can be provided on the inner wall of the housing 1 of the silencer. By providing the apertures 11 or the plate with apertures on the inner wall of housing 1, the noise resistance against the discharge noise of the compressor can be greatly improved, and the acoustics wave energy can be greatly absorbed, thereby further reducing the discharge noise.

In some embodiments, the diameter of the aperture 11 can range from ϕ1 mm to ϕ3 mm, or can be adjusted according to actual requirements.

Figure 4:
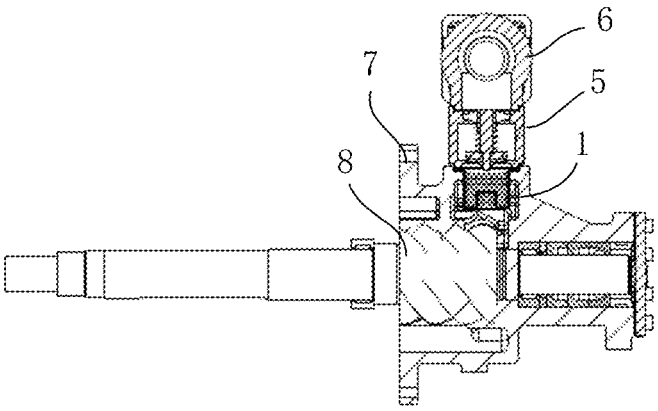
FIG. 4 is a schematic diagram illustrating the silencer installed in a compressor according to one or more embodiments of the present disclosure.

As shown in FIG. 4, in some embodiments, a check valve 5 can be arranged on the gas outlet end 20 of the housing 1 of the silencer, so as to prevent a backflow.

Further, in the direction of the gas flow, a cut-off valve 6 can be provided downstream of the check valve 5, so as to control gas discharging.

In the silencer provided by some embodiments, the apertures 11 or the plate with apertures 11 are provided on the inner wall of the housing 1, which can improve the noise resistance against the discharge noise and achieve the absorption for the acoustics wave energy of the discharge noise; the gas inlets 3 are uniformly distributed around the protrusion 2, which enables the gas flow to be divided and impact in the housing 1, thereby reducing the velocity of the gas flow, attenuating the energy and reducing the noise; the filter screen is provided in the housing 1, which can absorb the acoustics wave energy of the discharge noise and play a role in separating oil and gas. The arrangements of three aspects above can effectively reduce the discharge noise.

As shown in FIG. 3, the silencing principle of the silencer (whose protrusion 2 is a hollow structure) provided by some embodiments is as follows: after reaching the silencer, the discharged gas of the compressor is divided into two parts; a part of the gas flow enters the cavity of the protrusion 2, impacts on the top wall 21 and is dispersed, flowing back in large part, and entering the housing 1 through the through the opening 23 in small part; another part of the gas flow is divided into multiple streams of gas flow to enter the housing 1 through the gas inlets 3, and the multiple streams of gas flow impact and mix in the space between the closed portion of protrusion 2 and the filter screen 4, accordingly, the velocity of the gas flow is reduced; the gathered gas flow is filtered by the filter screen 4 and discharged, and the velocity of the gas flow is further reduced. After three steps of reducing velocity, the velocity of the gas flow is significantly reduced; the acoustics wave energy is significantly reduced by means of the noise resistance of the apertures on the interior wall of the housing 1, the impacting loss and the absorption loss, thereby achieving the purpose of silencing and reducing noise.

In some of the above embodiments, the silencer is in a long-term contact with the refrigerant and the frozen oil, and it is necessary to guarantee the strength and the corrosion resistance of the silencer, therefore the material of the silencer can preferably be stainless steel. However, in practice, other materials can also be selected according to the refrigerant.

The present disclosure further provides an exemplary embodiment of a compressor, and in the exemplary embodiment, the compressor includes the silencer in any one of the embodiments above.

By employing the silencer provided by the embodiment of the present disclosure, the discharge noise of the compressor can be reduced, and the oil and gas in the discharged gas of the compressor are separated, and the energy efficiency is improved.

The compressor in the above embodiments can include a screw compressor, and the screw compressor can further include a one-unit double-stage screw compressor, etc.

As shown in FIG. 4, the above-mentioned screw compressor can include a body 7, and a rotor assembly 8 is provided inside the body 7. The rotor assembly 8 includes a female rotor and a male rotor, and the silencer is disposed at a discharge port of the screw compressor.

In the screw compressor provided by some embodiments, the bottom of the housing 1 of the silencer is generally located above the tooth-tops of the female and male rotors of the rotor assembly 8 by 15 mm or more, so as to prevent the silencer from colliding with the rotor and being scratched.

In the screw compressor provided in some embodiments, a check valve 5 is provided on the gas outlet end 20 of the housing 1 of the silencer, and a gasket can be added between the check valve 5 and the silencer, to prevent the discharged gas from leaking. In the direction of the gas flow, a cut-off valve 6 can be provided downstream of the check valve 5. The cut-off valve 6 can be fixed on the body 7 with screws.

The silencer provided by the embodiments of the present disclosure can be applied to various conditions, and is not limited to the type of a low-temperature compressor or a one-unit two-stage screw compressor, but can also be applied to a conventional compressor with an oil separator. When the silencer is applied in a conventional compressor, the filter screen can be optionally cancelled because an oil filter screen of the oil separator is provided inside the compressor.

Since the space inside the discharge port of each of the compressors may be different, the silencer provided by the embodiments of the present disclosure can be adjusted in size according to the actual space, but the structure remains unchanged.

Finally, it should be noted that the above-described embodiments are only examples for illustrating the technical solutions of the present disclosure, but not intended to limit the present disclosure. Although the present disclosure is described in detail with reference to the preferable embodiments, it should be understood by those skilled in the art that several modifications of the specific embodiments of the present disclosure or equivalent replacements of partial technical features may be made without departing from the spirits of the technical solutions of the disclosure, and all modifications or equivalent replacements are within the protection scope of the present disclosure.

What is claimed is:

1. A silencer, comprising:

a housing comprising: (i) a gas inlet end, (ii) a gas outlet end having an opposed, spaced-apart relationship to the gas inlet end, and pi) an interior space of the housing, the interior space disposed between the gas inlet end and the gas outlet end;

a protrusion arranged in the gas inlet end of the housing and extending into the interior space of the housing, wherein a portion of the protrusion is closed portion that is proximate to the gas outlet end of the housing; and at least two gas inlets arranged in the gas inlet end of the housing and disposed around the protrusion;

wherein:

a space external to the housing and the interior space of the housing communicate directly by the at least two gas inlets;

the protrusion is a hollow structure, the protrusion comprises a top wall, and the top wall is the closed portion; and the protrusion comprises a circumferential side wall, and the circumferential side wall is provided with a through opening that is in communication with the interior space of the housing.

2. The silencer according to claim 1, a size of the through opening is smaller than a size of the at least two gas inlets.

3. The silencer according to claim 1, wherein a filter screen is arranged inside the housing, and the filter screen is arranged between the protrusion and the gas outlet end of the housing.

4. The silencer according to claim 3, wherein a distance between the filter screen and the protrusion is 10 mm or more.

5. The silencer according to claim 4, wherein apertures are provided on an inner wall of the housing.

6. A compressor, comprising the silencer of claim 4.

7. The compressor according to claim 6, comprising a screw compressor.

8. The compressor according to claim 7, wherein the silencer is disposed at a discharge port of the screw compressor.

9. The compressor according to claim 6, wherein a check valve is arranged on the gas outlet end of the housing.

10. The compressor according to claim 9, comprising a cut-off valve, and in a direction of a gas flow, the cut-off valve is provided downstream of the check valve.

* * * * *